United States Patent [19]

Burcham, Jr. et al.

[11] Patent Number: 4,730,627

[45] Date of Patent: Mar. 15, 1988

[54] METHOD AND APPARATUS FOR TREATING PARTICULATE MATERIAL

[75] Inventors: Walter E. Burcham, Jr., Yadkinville; Wilbur J. French, Jr., Walkertown, both of N.C.

[73] Assignee: R. J. Reynolds Tobacco Company, Winston-Salem, N.C.

[21] Appl. No.: 936,050

[22] Filed: Nov. 28, 1986

[51] Int. Cl.[4] ..... A24B 3/06; A24B 3/12

[52] U.S. Cl. ..... 131/305; 131/302; 131/306; 131/309

[58] Field of Search ..... 131/300, 302, 303, 304, 131/305, 306, 309, 310

[56] References Cited

U.S. PATENT DOCUMENTS 3,419,015 12/1968 Wochnowski .
4,054,145 3/1977 Berndt et al. .

FOREIGN PATENT DOCUMENTS 3001734 7/1981 Fed. Rep. of Germany .

*Primary Examiner*—V. Millin
*Attorney, Agent, or Firm*—Herbert J. Bluhm

[57] ABSTRACT

An improved method and apparatus for treating particulate material with a liquid additive in a rotatable cylinder involves the use of a pressurized fluid such as steam directed obliquely against the inner wall of the cylinder to effect a cleaning action on the inner wall as the cylinder is rotated and to augment agitation action produced by the rotational movement of the cylinder and gravitational forces acting on the particulate material. Strategically located spray nozzles apply controlled amounts of liquid additive to the particulate material as it is undergoing agitation by the combined effects of the applied forces. The method and apparatus disclosed are particularly suited to the treatment of tobacco with casing materials.

15 Claims, 4 Drawing Figures

METHOD AND APPARATUS FOR TREATING PARTICULATE MATERIAL

TECHNICAL FIELD

This invention relates to the treatment of particulate solids with streams of liquid or vaporous material as the particulate solids are undergoing agitation in a rotating cylinder or drum.

BACKGROUND ART

The application of liquid additives to particulate solid materials requires special processing techniques in order to achieve uniform distribution of the additives on the particulate solids. The uniform distribution of the additives is particularly important when the particulate solids include smoking materials such as tobacco and the liquid additives include flavorants.

In the processing of tobacco preparatory to the manufacture of smoking products therefrom, it is customary to apply casing or sauce materials to the tobacco in order to modify the flavor and smoking characteristics of the tobacco. Apparatus which has been conventionally used for applying the casing or sauce materials includes an elongated rotary drum or cylinder having its longitudinal axis positioned in a substantially horizontal manner but with sufficient incline to allow tobacco introduced at the higher end to move gradually through the rotating drum to the lower end where the tobacco exits. Spray nozzles positioned in the interior of the rotary drum are used to apply the casing or sauce materials to the tobacco as the tobacco moves through the drum. The inner wall of the drum is typically provided with pins, ribs or blades which impart a certain agitating action to the tobacco by causing the mass of tobacco particles to turn over as gravitational forces overcome the lifting action of the pins, ribs or blades attached to the rotating inner wall of the drum. This agitating action is not entirely satisfactory because the mass of tobacco particles tends to turn and roll down the inner wall of the drum with the net result that only the outer layer of tobacco particles in the "roll" is actually contacted with the additive spray. Thus, the additives applied to the tobacco are not uniformly distributed throughout the mass of particles and this leads to nonuniformity in the smoking qualities of smoking products prepared from the treated tobacco.

Those skilled in the art have sought to improve the uniformity of application of additives applied to tobacco by employing specially designed apparatus. One such attempt is disclosed in U.S Pat. No. 4,054,145 which describes a rather complex treating arrangement that includes a rotary winnower or jets of compressed air for propelling tobacco particles into a rotary drum. A plurality of spray nozzles are arranged to apply the desired additives to the tobacco particles as the propelled particles are descending into the lower portion of the drum. This apparatus poses operational problems in that the speed of the rotary winnower, the pressure of the compressed air and the control of the additive spray nozzles must be carefully coordinated with respect to the feed rate of the tobacco particles to insure uniform distribution of the additives on the tobacco.

Apart from the problem of achieving uniform distribution of additives sprayed onto the tobacco particles, the rotary drums used for applying casing or sauce materials to tobacco give rise to another operational problem that can result in nonuniformity of additives in the treated tobacco. This problem is the build-up of additive and tobacco materials on surfaces within the rotary drum. Significant quantities of such materials may occasionally be dislodged from the surfaces where they accumulate and may lead to concentrated pockets of additives in the treated tobacco mass. Succeeding process steps for the treated tobacco do not completely disperse these concentrated pockets of additives. The use of wiping blades or other devices to prevent accumulation of casing and tobacco materials on surfaces of the treating apparatus are not entirely effective for that purpose since it is virtually impossible to design wiping devices that will keep all of the surface areas free of accumulated deposits.

A rotary drum design which seeks to minimize the build-up of deposits on surfaces within the drum is disclosed in West German patent publication No. 30 01 734. The rotary drum described therein is provided with pins which extend radially inwardly a short distance and which serve to lift the tobacco particles as the drum is rotated. Positioned adjacent to the inner wall at a point that coincides with the highest elevation of the inner wall during its rotational movement is an axially arranged steam pipe that is provided with a number of holes bored in the wall of the pipe. Steam is ejected from these holes and is directed upwardly against the inner wall of the drum to remove any tobacco particles which may adhere to the inner wall. A number of flexible scrapers attached to the inner wall in the staggered, helical pattern provide a wiping action on the upper surface of the steam pipe to prevent build-up of deposits on the pipe and to prevent the holes in the steam pipe from becoming clogged. A wiping action is not, however, applied to a second pipe and associated nozzles through which the casing or sauce materials are directed. Also, the flexible wiping blades themselves present structures which are conducive to the accumulation of deposits on the inner wall of the drum. Additionally, the numerous lifting pins installed on the inner wall represent yet further structural elements around which tobacco and additive materials accumulate.

BRIEF SUMMARY OF THE INVENTION

This invention provides an improved method and apparatus for treating particulate solids with liquid or vaporous materials thereby resulting in a more uniform distribution of the liquid or vaporous material throughout the mass of particulate solids.

It is a principal object of this invention to provide an improved treating arrangement that includes a rotatable cylinder or drum with associated spray nozzles for applying liquid additive materials to particulate solids.

It is a further object of this invention to provide an improved treating arrangement which minimizes the accumulation of deposits of particulate solids and additive materials on surfaces within the treating apparatus.

These objects and other advantages of the invention are achieved by employing strategically located spray nozzles for directing a pressurized fluid against the inner wall surface of the rotatable cylinder to prevent accumulation of deposits and to enhance the agitation action and particle separation effect exerted on the particulate solids by the rotational movement of the cylinder. Other operating parameters are carefully controlled and monitored as described below in order to achieve the improved results obtainable with this invention.

DETAILED DESCRIPTION OF THE INVENTION

Figure 1:
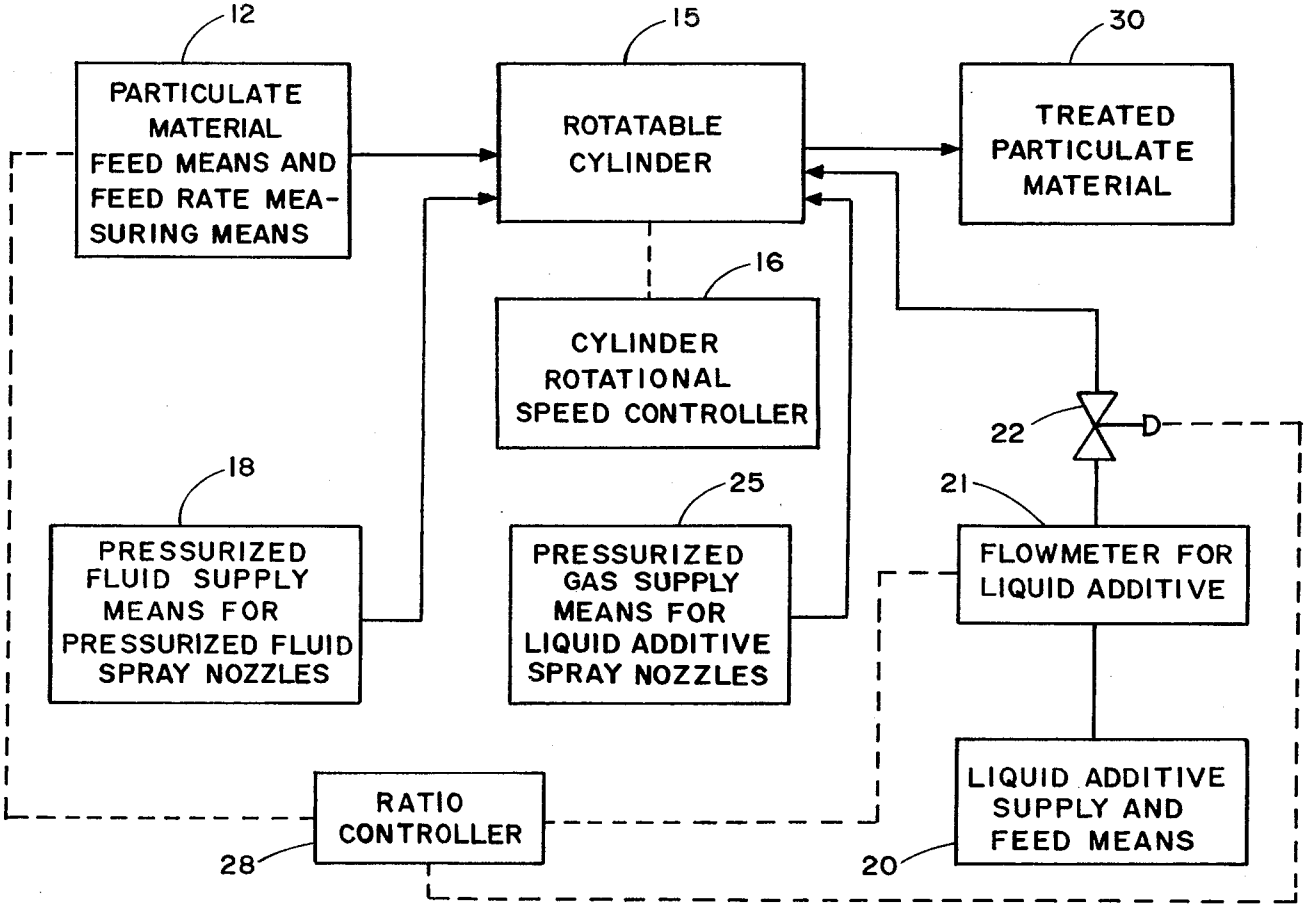
FIG. 1 is a block diagrammatic representation of the treating arrangement used in accordance with the present invention.

The present invention provides improved apparatus for treating particulate material with a liquid additive and includes an elongated rotatable cylinder whose longitudinal axis is disposed in a substantially horizontal position and which has an entrance end for introducing particulate material into the cylinder and an exit end for discharging treated particulate material. The inner wall of the cylinder has associated therewith a plurality of flights designed to enhance the lifting action exerted on the particulate material as it is carried upwardly to a predetermined point by the portion of the inner wall that is rising during rotation of the cylinder. Suitable means are provided for rotating the elongated cylinder at a speed that is sufficient to cause the particulate material to be carried upwardly to the predetermined point. A first group of stationary nozzles is arranged adjacent to the portion of the inner wall that is rising during rotation of the cylinder. The first group of stationary nozzles extends in a longitudinal direction along a substantial length of the inner wall of the cylinder with the nozzles being oriented so that fluid streams emerging from the nozzles impinge obliquely against the inner wall of the cylinder in a direction that is substantially opposite to the direction of movement of the inner wall. The impingement of the fluid streams on the inner wall causes any particulate material adhering to the rising inner wall to be dislodged therefrom. The fluid streams emerging from the nozzles also serve to augment the agitation action resulting from the gravitational effect on the particulate material that has temporarily separated from the rising inner wall. A second group of stationary nozzles is strategically positioned within the rotatable cylinder at a location that permits liquid additive supplied to this second group of nozzles to be sprayed onto the particulate material as it is subjected to the agitation action in the rotating cylinder. The apparatus also includes means for supplying a pressurized fluid to the first group of stationary nozzles and separate means for supplying quantities of liquid additive to the second group of stationary nozzles. The apparatus is also provided with means for monitoring the feed rate of particulate material introduced into the entrance end of the cylinder and with means for regulating the quantities of liquid additive supplied to the second group of stationary nozzles with respect to the feed rate of particulate material introduced into the entrance end of the cylinder.

Thus, the apparatus disclosed herein provides a method for uniformly applying a liquid additive to particulate material by moving a continuous stream of particulate material through a rotating cylinder that is provided with an entrance end and an exit end for introducing and withdrawing, respectively, the particulate material. By regulating the rotational speed of the cylinder so that the angular velocity of the inner wall surface is maintained within an effective range, the particulate material is carried upwardly by the rising inner wall of the rotating cylinder to a predetermined point at which a major portion of the particulate material begins to separate from the rising inner wall due to the influence of gravity. The method also involves directing an elongated band of pressurized fluid obliquely against the rising inner wall in a direction that is substantially opposite to the direction of movement of the inner wall and at a location above the predetermined point at which a major portion of the particulate material begins to separate from the inner wall due to the influence of gravity, the pressurized fluid serving to dislodge any particulate material adhering to the inner wall surface and to augment the agitation action which is exerted on the particulate material by gravitational forces and the rotational movement of the cylinder. As the continuous stream of particulate material is agitated by the combined effects of gravitational forces, the rotational movement of the cylinder and the elongated band of pressurized fluid directed obliquely against the inner wall of the cylinder, the particulate material is subjected to a gas-atomized spray of liquid additive with the amount of liquid additive sprayed being controlled with respect to the quantity of particulate material introduced into the rotating cylinder to obtain the desired additive application levels on the particulate material.

The basic design of the rotatable cylinder or drum used in connection with this invention is conventional insofar as it involves an elongated cylinder having openings on either end thereof with the cylinder being fabricated from a suitable material such as stainless steel and being provided with means for rotating the cylinder about its longitudinal axis. The cylinder is supported in a substantially horizontal position but is preferably operated with the entrance end in a slightly elevated position with respect to the discharge end (i.e., incline angles up to 20 degrees from horizontal) in order to facilitate movement of particulate material through the cylinder. The means for rotating the cylinder about its longitudinal axis should preferably include means for controlling the rotational speed of the cylinder within a specified range as discussed below.

The inner wall of the rotatable cylinder is provided with a series of cooperating flights which carry particulate material upwardly and impart a tumbling type of agitating action to the particulate material as the cylinder is rotated. The cooperating flights preferably comprise elongated structures whose longitudinal axes are substantially parallel to the longitudinal axis of the cylinder and they are helically arranged on the inner wall with respect to the direction of rotation of the cylinder to produce a cooperating effect. The number of flights installed on the inner wall is not critical but they should project radially inwardly from the surface of the inner wall only a short distance to minimize surface areas where the materials being processed can accumulate and to prevent physical contact with spray nozzles positioned adjacent to the inner wall of the cylinder. The cross-sectional shape of the elongated flights may vary but should avoid the creation of crevices or recesses between the flights and the inner wall surface of the cylinder where deposits of process materials can collect. One preferred cross-sectional shape for the flights is semicircular with the flat side of each flight in contact with the inner wall of the cylinder. Another suitable design is that which approximates the shape of a wedge with the blunt end of the wedge being presented as the leading edge of the flight in the rotational movement of the cylinder. Regardless of the shape selected, the flights should be securely affixed to the inner wall of the cylinder by welding or other suitable means.

The helically arranged flights affixed to the inner wall of the cylinder provide a lifting action as well as a tumbling type of agitation action that is applied to the particulate material introduced into the cylinder. The degree to which the particulate material is carried upwardly by the rising wall of the rotating cylinder is influenced by several factors including the physical characteristics and moisture content of the particulate material, the design of the flights and the centrifugal force applied to the particulate material by the rotational speed of the cylinder. For a selected particulate material and cylinder design, the upward movement of the particulate material can be controlled to a large degree by regulating the rotational speed of the cylinder. If the particulate material comprises tobacco strips, for example, regulating the rotational speed so that the angular velocity of the inner wall surface of the cylinder is maintained between approximately 1.5 and 2.0 meters per second results in the tobacco strips being carried upwardly by the rising inner wall about 90 to 120 degrees above the lowest point in the circumferential path of the cylinder wall. Cylinder rotational speeds required for shredded tobacco and other particulate materials may be somewhat different but can be easily determined by trial and observation during operation of the equipment. Thus, it is preferred that the apparatus of the present invention include means for regulating the rotational speed of the cylinder so that the point at which a major portion of the particulate material begins to separate from the inner wall due to the influence of gravity can be substantially controlled.

One of the principal improvements discovered in connection with the present invention is that the use of a pressurized fluid substantially increases the agitation action that is applied to the particulate material while at the same time the fluid essentially eliminates the accumulation of deposits on the inner wall of the cylinder and other surfaces in the treating zone. This improvement is accomplished by utilizing a plurality of stationary spray nozzles arranged in a spaced relationship to provide an elongated band of pressurized fluid extending in a direction that is generally parallel to the longitudinal axis of the cylinder. These stationary spray nozzles are positioned within the rotatable cylinder adjacent to the rising inner wall thereof so that the pressurized fluid streams emerging from the nozzles impinge obliquely against the rising inner wall of the cylinder in a direction that is substantially opposite to the direction of rotational movement of the inner wall. The point at which the fluid impinges on the rising inner wall of the cylinder is located between the point at which a major portion of the particulate material being carried upwardly begins to separate from the rising inner wall due to the influence of gravity and the point at which the rising inner wall of the cylinder reaches its apex. The force of the pressurized fluid impinging on the rising inner wall of the cylinder not only dislodges any particulate material adhering to the inner wall but also substantially disperses the material that has temporarily separated from the rising inner wall and is falling downwardly under the influence of gravity. Thus, not only is the inner wall of the cylinder effectively cleaned but the agitation action produced by gravitational forces and the rotational movement of the cylinder is augmented by the elongated band of pressurized fluid directed against the rising inner wall of the cylinder.

The precise location of the pressurized fluid spray nozzles and the spacing between adjacent nozzles will depend on certain factors such as the nozzle design employed, the supply pressure of the fluid directed to the nozzles and the type of fluid utilized. For example, nozzles comprising holes bored in the wall of a pipe would require somewhat closer spacing between adjacent holes than nozzles designed to emit a wide angle flat spray pattern of fluid. It is preferred that the pressurized fluid be directed through nozzles capable of generating a flat spray pattern. Such nozzles are commercially available as are other types of nozzles which could be employed including those which emit a cone-shaped spray pattern. Fluids useful in connection with this invention include air, steam and inert gases such as nitrogen. It is preferred, however, that steam be employed as the pressurized fluid when the particulate material is vegetative matter such as tobacco because the steam contributes a desirable conditioning and moistening effect to the material and can also be effective for heating the tobacco to a desired temperature during its movement through the cylinder. The supply pressure for the pressurized fluid should be at least 2.0 kilograms per square centimeter absolute and should not exceed 10 kilograms per square centimeter absolute. The pressures employed will depend primarily on the size of the rotatable cylinder with smaller diameter cylinders requiring somewhat lower fluid pressures than larger diameter cylinders. High fluid pressures should be avoided due to the cyclonic effect created which may carry particulate material upwardly in a direction substantially opposite to the direction of rotation of the cylinder. For a cylinder having a diameter of about 2 meters it has been found that fluid pressures of about 3.0 to 5.0 kilograms per square centimeter are effective for accomplishing the desired objectives.

It is important that the pressurized fluid be directed in an oblique, substantially opposing fashion against the inner wall of the rotating cylinder. This will ensure that effective agitation forces will be applied to the particulate material as it is separating from the rising inner wall of the cylinder and is falling under the influence of gravity. It will also ensure that particulate material is not carried upwardly to a point higher than the nozzles. By limiting the upward movement of the particulate material, the possibility of particulate material dropping down onto and accumulating on the nozzle structures and associated piping is minimized. The particular angle at which the pressurized fluid obliquely impinges against the inner wall of the cylinder is not critical except that perpendicular impingement is to be avoided since that could lead to upward deflection of dislodged particulate material and possible deposition on the nozzle structures and associated piping. Preferably, the impingement angle should not exceed 60 degrees and, most preferably, should be between approximately 20 and 50 degrees as this will give the desired cleaning action and will also produce effective agitation forces on the particulate material by direct impingement as well as by pressurized fluid deflected by the inner wall of the cylinder.

The liquid additive that is to be applied to the particulate material being processed is sprayed onto the material via a second group of stationary nozzles positioned within the rotatable cylinder. The number of spray nozzles employed for this purpose will depend on the length of the cylinder, the flow rate of the particulate material moving through the cylinder and the liquid additive levels desired in the treated material. Generally, at least two liquid additive spray nozzles will be required for the typical treating installation. It is also preferred that gas-atomizing spray nozzles be used because they will maintain a satisfactory spray pattern at both high and low flow rates of liquid. The liquid additive spray nozzles are preferably positioned in a stationary manner above the mass of particulate material moving through the rotating cylinder with the nozzles directing their spray into the zone where maximum agitation of the particulate material is effected by the combined forces of the rotational movement of the cylinder and gravity on the particulate material temporarily separated from the rising inner wall of the cylinder and by the pressurized fluid impinging against the inner wall of the cylinder.

For a better understanding of the present invention, reference will now be made to the accompanying drawings which portray a preferred embodiment that is ideally suited to the processing of tobacco in particulate form.

In the block diagram shown in FIG. 1 rotatable cylinder 15 is provided with speed controller 16 for regulating the rotational speed of cylinder 15. Tobacco in particulate form such as strips or shreds is introduced into cylinder 15 by feed means 12 which is provided with means for measuring the feed rate of tobacco introduced into cylinder 15. Pressurized fluid spray nozzles 41 (see FIGS. 2 and 3) positioned within rotatable cylinder 15 are supplied with a pressurized fluid (preferably steam at about 4.5 kilograms per square centimeter absolute) by supply means 18. Liquid additive spray nozzles 48 (see FIGS. 2 and 3) of the gas-atomizing type and positioned within cylinder 15 are supplied with controlled amounts of liquid additive by supply and feed means 20 via flowmeter 21 and control valve 22. Pressurized gas for the gas-atomizing nozzles 48 is provided by supply means 25. Ratio controller 28 receives signals from feed means 12 and flowmeter 21 indicating flow rates of tobacco and liquid additive, respectively, and sends a control signal to control valve 22 which will maintain the ratio of the two flow rates at the desired value. Treated tobacco 30 is discharged by cylinder 15 for further processing.

Figure 2:
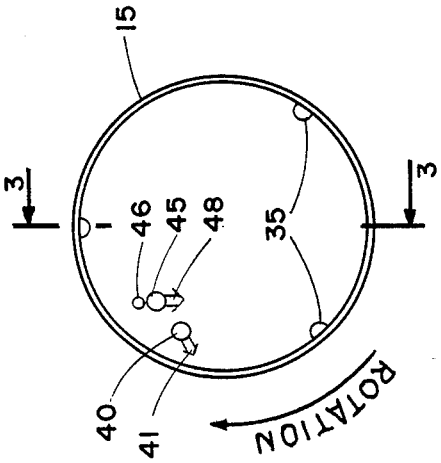
FIG. 2 is an end elevational view of the entrance end of a rotatable cylinder in accordance with one embodiment of the invention.
Figure 3:
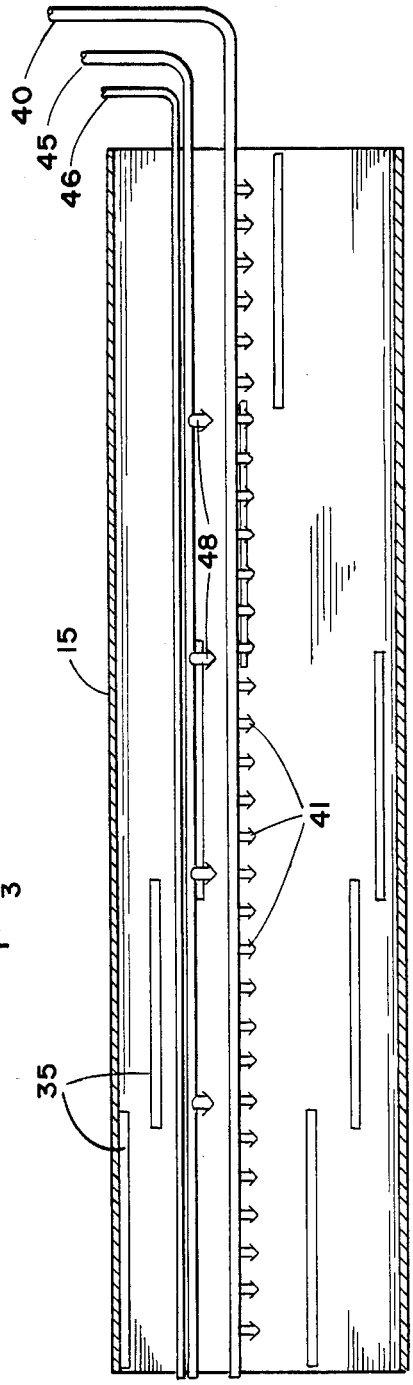
FIG. 3 is a cross-sectional view of the cylinder shown in FIG. 2 with additional details of the spray nozzle arrangement and inner wall flights depicted therein.

Additional details of rotatable cylinder 15 and associated nozzle assemblies are shown in FIGS. 2 and 3. Closely spaced nozzles 41 are installed in conduit 40 and are aimed at the inner wall of cylinder 15 at an oblique angle. Pipe 45 is provided with four gas-atomizing spray nozzles 48 installed at spaced intervals along a section of the pipe. Pressurized gas for spray nozzles 48 is supplied by conduit 46. For the sake of simplicity the actual connections between conduit 46 and each of spray nozzles 48 are not shown since such connections are conventional and well known in the art. Also not shown are support structures for the nozzle assemblies which are generally needed to maintain the nozzles 41 and 48 in the desired stationary positions. Those support structures are also conventional and well known in the art. The inner wall of cylinder 15 is provided with a number of elongated flights 35 having semicircular cross sections. Each series of flights consists of five helically arranged elements collectively extending from the entrance end to the exit end of cylinder 15. In the embodiment shown cylinder 15 is provided with three groups of flights which are arranged for clockwise rotation of cylinder 15 as viewed from the entrance end of the cylinder.

Figure 4:
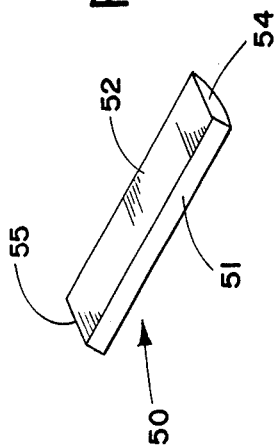
FIG. 4 is a perspective view of a modified form of flight that may be used with this invention.

An alternative design for flights which may be used with the present invention is shown in FIG. 4. In this design an elongated flight 50 having a transverse cross sectional shape that approximates a wedge is installed on the inner wall of the cylinder so that surface 51 constitutes the leading edge of the flight and makes initial contact with the mass of particulate material as the cylinder is rotated. Surface 52 is substantially larger than surface 51 due to the gently sloping nature of surface 52. The plane of surface 51 should be sloped more steeply but should preferably not approach a position that would result in surface 51 being perpendicular to the inner wall of the cylinder. The degree of inclination of surface 51 should be such that the surface provides the necessary resistance to the mass of particulate material to carry the particulate material upwardly while, at the same time, it permits the pressurized fluid impinging on the inner wall of the cylinder to remove any process materials from surface 51 as well as from that portion of the inner wall adjacent to surface 51. End plates 54 and 55 are designed to engage the inner wall surface of the cylinder in sealing contact. In a manner analogous to that depicted in FIG. 3, flights 50 are arranged on the inner wall of the cylinder in a cooperating, helical manner to exert a lifting action and a tumbling action on the particulate material being processed.

Although the present invention has been described in terms of specific embodiments, it is apparent that other embodiments embracing the basic concepts disclosed herein could be employed to achieve similar results. All such variations are deemed to be a part of this invention.

What is claimed is:

1. Improved apparatus for treating particulate material with a liquid additive comprising in combination (a) an elongated rotatable cylinder whose longitudinal axis is disposed in a substantially horizontal position and having an entrance end for introducing particulate material into the cylinder and an exit end for discharging treated particulate material, said cylinder also having an inner wall that has associated therewith a plurality of flights designed to enhance the lifting action exerted on the particulate material as it is carried upwardly to a predetermined point by the portion of the inner wall that is rising during rotation the of cylinder, (b) means for rotating said elongated rotatable cylinder at a speed that is sufficient to cause said particulate material to be carried upwardly to said predetermined point, (c) a group of stationary nozzles arranged adjacent to the inner wall of the cylinder with the nozzles in said group of stationary nozzles extending in a longitudinal direction along a substantial length of the inner wall of the cylinder and being oriented so that fluid streams emerging from the nozzles impinge obliquely against a portion of the inner wall that is rising during rotation of the cylinder at or above said predetermined point and in a direction that is substantially opposite to the direction of movement of said inner wall thereby causing any particulate material adhering to the rising inner wall to be dislodged therefrom, said fluid streams emerging from the nozzles also serving to augment the agitation action resulting from the gravitational effect on the particulate material that has temporarily separated from the rising inner wall, (d) a plurality of liquid additive spray nozzles positioned within the cylinder at a location that permits liquid additive supplied to said plurality of nozzles to be sprayed onto the particulate material as it is subjected to said agitation action, (e) means for supplying a pressurized fluid to said group of stationary nozzles, (f) means for monitoring the feed rate of particulate material introduced into the entrance end of the cylinder and (g) means for supplying quantities of liquid additive to said plurality of liquid additive spray nozzles which are regulated with respect to said feed rate of the particulate material into the entrance end of the cylinder.

2. The apparatus of claim 1 wherein said group of stationary nozzles is positioned adjacent to the inner wall of the cylinder intermediate between said predetermined point to which particulate material is carried by the rotating cylinder and the point at which the rising inner wall of the cylinder reaches its apex.

3. The apparatus of claim 1 wherein the entrance end of the rotatable cylinder is slightly elevated with respect to said exit end and each of said plurality of flights comprises an elongated structure projecting a short distance radially inwardly from the surface of the inner wall with the longitudinal axis of said elongated structure being substantially parallel to the longitudinal axis of said rotatable cylinder.

4. The apparatus of claim 3 wherein said flights are helically arranged on the inner wall of the rotatable cylinder.

5. The apparatus of claim 3 wherein said means for rotating the rotatable cylinder includes means for regulating the rotational speed of said rotatable cylinder so that the angular velocity of the inner wall surface of the cylinder is maintained within the range of 1.5 to 2.0 meters per second.

6. The apparatus of claim 1, 2, 3, 4 or 5 wherein the means for supplying pressurized fluid to said group of stationary nozzles comprises a source of steam under pressure.

7. The apparatus of claim 1, 2, 3, 4 or 5 wherein said plurality of liquid additive spray nozzles includes a nozzle of gas-atomizing type.

8. The apparatus of claim 6 wherein said plurality of liquid additive spray nozzles includes a nozzle of the gas-atomizing type.

9. A method for uniformly applying a liquid additive to particulate material comprising the steps of (a) moving a continuous stream of particulate material through a rotating cylinder that is provided with an entrance end and an exit end for introducing and withdrawing, respectively, the particulate material, said rotating cylinder having its longitudinal axis disposed in a substantially horizontal position and having an inner wall with a plurality of flights associated therewith for contacting and effecting a lifting action on the particulate material as it moves through the cylinder, (b) regulating the rotational speed of the cylinder so that the angular velocity of the inner wall surface is maintained at a sufficient level to cause said particulate material to be carried upwardly by the rising inner wall of the cylinder to a predetermined point at which a major portion of the particulate material begins to separate from the inner wall due to the influence of gravity, (c) directing an elongated band of pressurized fluid obliquely against the rising inner wall in a direction that is substantially opposite to the direction of movement of the inner wall and at a location above said predetermined point at which a major portion of the particulate material begins to separate from the inner wall due to the influence of gravity, said band of pressurized fluid serving to dislodge any particulate material adhering to the inner wall surface and to augment the agitation action which is exerted on the particulate material by gravitational forces and the rotational movement of the cylinder, (d) subjecting the particulate material to a spray of the liquid additive as the particulate material is being agitated by the combined effects of gravitational forces, the rotational movement of the cylinder and the elongated band of pressurized fluid directed obliquely against the inner wall of the cylinder and (e) controlling the amount of liquid additive sprayed onto said particulate material with respect to the quantity of particulate material introduced into the rotating cylinder.

10. The method of claim 9 wherein the pressurized fluid directed against the inner wall is steam supplied by a source of steam that is maintained at a pressure between 2.0 and 10.0 kilograms per square centimeter absolute.

11. The method of claim 10 wherein the pressurized fluid is directed against the rising inner wall in an area located between said predetermined point at which a major portion of the upwardly moving particulate material begins to separate from the inner wall due to the influence of gravity and the point at which the rising inner wall of the cylinder reaches its apex.

12. The method of claim 11 wherein the longitudinal dimension of the elongated band of pressurized fluid is oriented in a direction that is substantially parallel to the longitudinal axis of the rotating cylinder.

13. The method of claim 9, 10, 11, or 12 wherein the particulate material comprises tobacco and the liquid additive comprises a mixture of tobacco casing materials.

14. The method of claim 13 wherein the angular velocity of the inner wall surface of the rotating cylinder is maintained between 1.5 and 2.0 meters per second.

15. The method of claim 9 wherein the particulate material is subjected to a gas-atomized spray of the liquid additive as the particulate material is being agitated.

* * * * *